United States Patent [19]

Smilgys

[11] 4,230,937

[45] Oct. 28, 1980

[54] FUEL DELIVERY SAFETY LIMIT MECHANISM

[75] Inventor: Bruno S. Smilgys, Hartford, Conn.

[73] Assignee: Veeder Industries, Inc., Hartford, Conn.

[21] Appl. No.: 23,239

[22] Filed: Mar. 23, 1979

[51] Int. Cl.[3] ..... B67D 5/22; G06C 15/42

[52] U.S. Cl. ..... 235/94 R; 235/132 R; 235/144 D; 222/20; 222/32

[58] Field of Search ..... 235/94 R, 132 R, 139 R, 235/144 R, 144 D, 144 EA; 222/14, 15, 20, 21, 32, 33

[56] References Cited

U.S. PATENT DOCUMENTS

| | | | |
|---|---|---|---|
| 2,814,444 | 11/1957 | Bliss | 235/94 R |
| 3,006,504 | 10/1961 | Young | 222/15 |
| 3,128,910 | 4/1964 | Calhoun | 222/20 |
| 3,138,289 | 6/1964 | Jones, Jr. et al. | 222/20 |
| 3,371,860 | 3/1968 | Sundblom | 235/144 D |
| 3,459,330 | 8/1969 | Bickford et al. | 222/20 |

*Primary Examiner*—L. T. Hix
*Assistant Examiner*—Benjamin R. Fuller
*Attorney, Agent, or Firm*—Prutzman, Kalb, Chilton & Alix

[57] ABSTRACT

A fuel dispenser with a resettable register having a safety limit mechanism for limiting the amount of fuel dispensed by means of a gear trip mechanism indexed by the register to trip a shut-off valve after an adjustable safety limit is dispensed. The trip mechanism is reset for a succeeding delivery automatically by the register reset mechanism during the register reset cycle or manually by a reset push-button on the dispenser.

5 Claims, 2 Drawing Figures

FUEL DELIVERY SAFETY LIMIT MECHANISM

BRIEF SUMMARY OF THE INVENTION

The present invention relates generally to fluid dispensing apparatus and in particular to a new and improved fluid delivery safety limit mechanism having notable utility in self-service fuel dispensers for automatically limiting the amount of fuel dispensed.

It is a principal aim of the present invention to provide a new and improved fuel delivery safety limit mechanism for automatically discontinuing a fuel delivery after an established amount is dispensed and for thereby limiting the safety hazard from negligent or accidental fuel spillage.

It is another aim of the present invention to provide a new and improved fuel delivery safety limit mechanism for automatically discontinuing the delivery of fuel after an established safety limit is dispensed.

It is still further aim of the present invention to provide a new and improved fuel delivery safety limit mechanism of the type described which may be manually reset during the delivery of fuel for continuing the delivery.

It is another aim of the present invention to provide a new and improved fuel delivery safety limit mechanism which employs a manually adjustable safety limit.

It is another aim of the present invention to provide a new and improved fuel delivery safety limit mechanism which is of economical construction and which provides reliable operation over a long service free life.

It is a still further aim of the present invention to provide a new and inexpensive fuel delivery safety limit mechanism which may be employed with a conventional fuel pump register.

Other objects will be in part obvious and in part pointed out more in detail hereinafter.

The invention accordingly consists in the features of construction, combination of elements and arrangement of parts which will be exemplified in the construction hereafter set forth, and the scope of the application of which will be indicated in the appended claims.

DESCRIPTION OF THE PREFERRED EMBODIMENT

Figure 1:
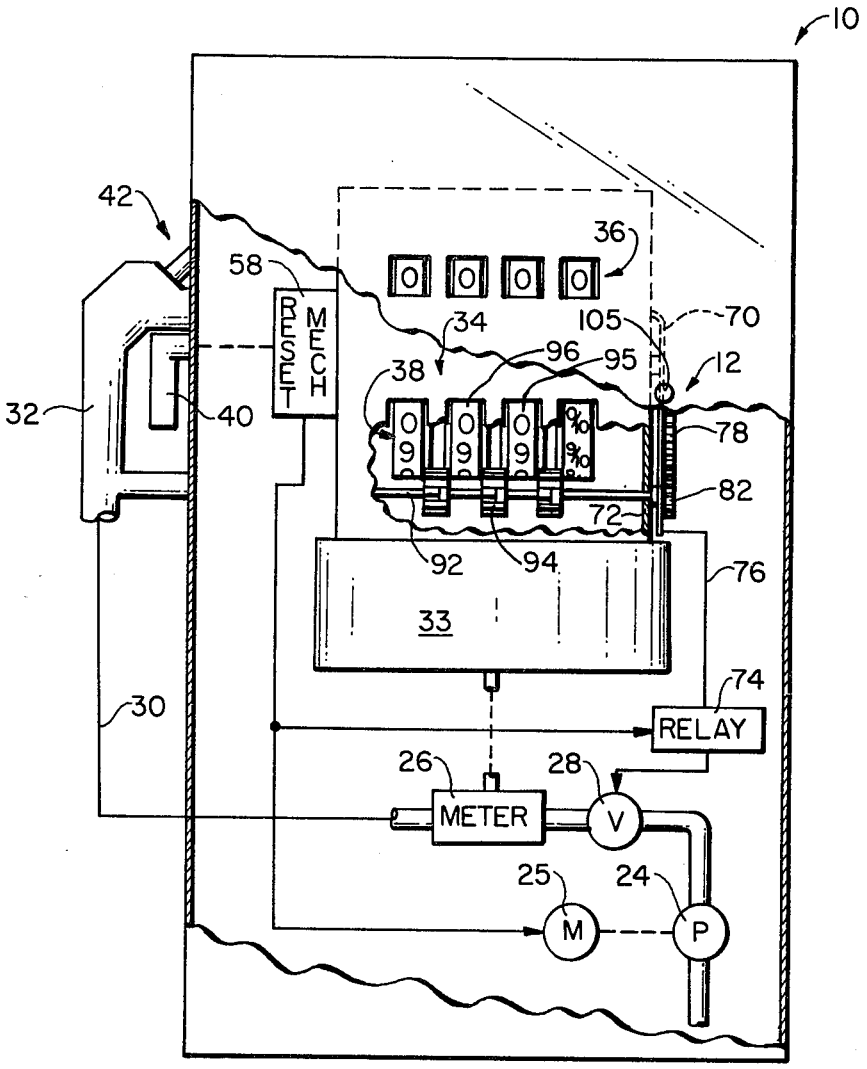
FIG. 1 is a front elevation view, partly broken away and partly in section, of a fuel dispenser employing an embodiment of a fuel delivery safety limit mechanism of the present invention.

Referring now to the drawings in detail, a gasoline pump or dispenser 10 is shown incorporating an embodiment 12 of a safety limit mechanism of the present invention for automatically terminating the delivery of fuel after an established safety limit is dispensed.

In a conventional manner, the gasoline dispenser 10 is shown having a fuel pump 24 driven by a motor 25 for supplying fuel via a meter 26, a solenoid operated shut-off valve 28 and a fuel delivery hose 30 to a fuel dispensing nozzle 32. The meter 26 is connected via a variator 33 to drive a register 34 having cost and volume counters 36, 38 for registering the cost and volume amounts of fuel delivered. A manually operable control handle 40 is mounted adjacent a nozzle storage boot or receptacle 42 so that the handle 40 must be manually rotated to a vertical or "off" position before the nozzle 32 can be returned to its storage receptacle. Thereafter, the nozzle 32 must be removed from its storage receptacle 42 to permit the handle to be rotated to its horizontal or "on" position.

When the handle 40 is turned to its "off" position at the end of a fuel delivery, a control switch (not shown) is thereby operated to de-energize the pump motor 25 and thereby deactivate the dispenser 10. When the handle 40 is subsequently turned to its "on" position to commence a succeeding delivery, a reset mechanism 58 is actuated by the handle 40 to reset the cost and volume counters 36, 38 of the register 34. The register reset mechanism 58 could be of the type disclosed in U.S. Pat. No. 2,814,444 of H. N. Bliss, dated Nov. 26, 1957 and entitled "Register", so that when the handle 40 is rotated to its "on" position the reset mechanism 58 is mechanically tripped to rotate a reset shaft 63 one full revolution to reset the register 34.

At the end of the reset cycle, the reset mechanism 58 actuates the control switch (not shown) to energize the pump motor 25. Fuel can then be delivered with the nozzle 32. Thereafter, the dispenser 10 can be deactivated when desired by turning the handle 40 to its "off" position.

The fuel delivery safety limit mechanism 12 is shown associated with the volume counter 38 for operating the shutoff valve 28 to deactivate the dispenser 10 after a fixed volume safety limit amount of fuel is dispensed. The safety limit mechanism 12 is presettable to limit the volume amount of fuel delivered to for example, either 10, 20, or 30 gallons and to close the valve 28 after the established fixed volume limit is dispensed.

The safety limit mechanism 12 comprises a valve control or trip lever 70 pivotally mounted on a stub shaft extension 71 of the usual register sideplate 72 and connected to a valve relay 74 by a rod 76. In its active or delivery position shown in FIG. 2, the valve control lever 70 operates the relay 74 to hold the solenoid operated shut-off valve 28 open against the bias of a suitable valve closure spring (not shown).

Figure 2:
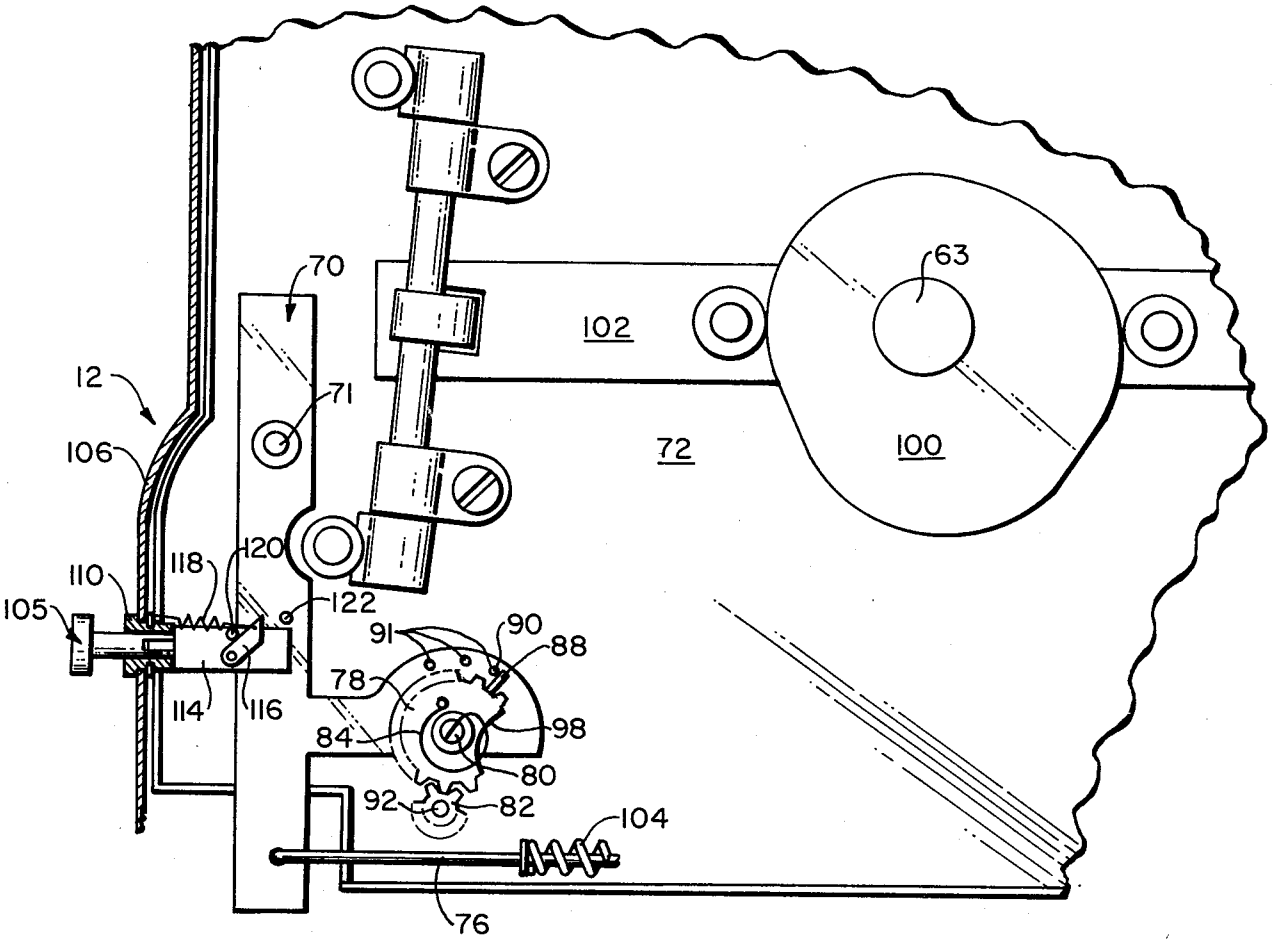
FIG. 2 is a partial enlarged side elevation view, partly broken away and partly in section, of a fuel dispenser register showing the safety limit mechanism in greater detail.

A trip gear 78 is rotably mounted on an upstanding stub shaft 80 fixed to the control lever 70 for engagement with a drive gear 82 driven by the volume counter 38. A spiral torsion spring 84 encircling the fixed stub shaft 80 biases the trip gear 78 in the counterclockwise angular direction as viewed in FIG. 2. When the control lever 70 is pivoted or shifted, counterclockwise as shown in FIG. 2 from its active or dispensing position shown in FIG. 2, the trip gear 78 is pivoted out of engagement with its drive gear 82 and is thereby freed to be rotated by the torsion spring 84 to its reset position established by the engagement of a radial pin 88 on the trip gear 78 with a threaded stop pin 90 mounted on the control lever 70. The control lever 70 has three threaded openings 91 for selectively mounting the threaded stop pin 90 at 10, 20, and 30 gallon angularly spaced limit settings.

The drive gear 82 is secured onto an outer extension of an elongated transfer pinion shaft 92 of the volume counter 38. The transfer pinion 94 (FIG. 1) between the gallon and ten gallon number wheels 95, 96, of the volume counter 38 is also secured to the transfer pinion shaft 92 for indexing the drive gear 82. Thus, when a transfer is transmitted from the gallon wheel 95 to the ten gallon wheel 96, the drive gear 82 is indexed one-fourth of a revolution to rotate the trip gear 78, in the clockwise direction as viewed in FIG. 2.

The trip gear 78 has a peripheral recess or slot 98 of sufficient circumferential width and radial depth to release the trip gear 78 for pivotal movement toward the drive gear 82. Thus, after the trip gear 78 has been rotated an established angle from its initial angular position (determined by the position of the adjustable stop pin 90) to a trip angular position where the peripheral recess 98 is aligned for receiving the drive gear 82, the trip gear 78 and its supporting lever 70 are released to pivot the control lever 70, in the clockwise direction as viewed in FIG. 2, to open the valve relay 74. The shut-off valve 28 is thereupon closed to deactivate the dispenser 10 and terminate the delivery of fuel.

Thereafter, a succeeding delivery can be made by cycling the handle 40 to its "off" position and back to its "on" position. During the accompanying register reset cycle, the valve control lever 70 is pivoted, in the counterclockwise direction as viewed in FIG. 2, to open the valve 28 and reset the trip gear 78. For that purpose, a conventional reset cam 100 mounted on the reset shaft 63 is operable via the usual reset slide 102 to momentarily pivot the valve control lever 70 outwardly against the bias of its return spring 104. Once the reset cycle is completed and the pump motor 25 is re-energized, fuel may be dispensed again in the normal manner and the trip mechanism 12 is conditioned to be effective to automatically terminate the succeeding fuel delivery after the established safety limit is dispensed.

Also, a manual reset plunger 105 is shown mounted on the dispenser housing 106 for manually resetting the safety limit mechanism 12. The dispenser 10 can then be employed to continue to dispense fuel without resetting the register when for example an extra large delivery is being made or when the safety limit mechanism 12 is preset at a relatively low volume safety limit. Nonetheless, the safety limit mechanism 12 will limit any accidental or negligent spill of gasoline, as it is not expected that the manual reset plunger 105 would be used when such a spill occurs.

The reset plunger 105 is slidably mounted within a bushing 110 on the dispenser housing 106 to extend adjacent the control lever 70. A pawl 116 is pivotably mounted on an inner plate member 114 of the plunger 105, and a tension spring 118 is connected between the pawl 116 and support bushing 110 to normally maintain the pawl 116 against a stop 120 and the plunger 105 in its outer or withdrawn position shown in FIG. 2 with the plate member 114 in engagement with the support bushing 110. When the plunger 105 is actuated inwardly, the pawl 116 engages an abutment pin 122 on the control lever 70 to pivot the lever to reset the trip mechanism 12. Also, the pin 122 is located to ride over the pawl 116, after the control lever 70 is pivoted sufficiently to reset the trip mechanism, to prevent using the plunger 105 to hold the control lever 70 withdrawn.

As will be apparent to persons skilled in the art, various modifications, adaptations and variations of the foregoing specific disclosure can be made without departing from the teachings of the present invention.

I claim:

1. In a fluid dispenser having a resettable register for registering the amount of fluid dispensed, a fluid delivery system with control means selectively operable to activate and deactivate the fluid delivery system for dispensing fluid and a limit mechanism for operating the control means to deactivate the delivery system after an established amount of fluid is dispensed, the improvement wherein the limit mechanism comprises trip gearing with a rotary drive gear rotated by the resettable register in accordance with the amount of fluid dispensed and a rotary trip gear in operative intermeshing engagement with the drive gear and rotated thereby in one angular direction during the delivery of fluid from an initial angular position thereof to a trip angular position thereof, the trip gear having a circumferentially extending peripheral recess for receiving the drive gear when the trip gear reaches its trip position, a shiftable trip member rotatably supporting the trip gear and shiftable from a first position of the trip member to a second trip position thereof, when the trip gear receives the drive gear at its trip angular position, to operate the control means to deactivate the dispenser, and reset means for resetting the trip gear to its said initial angular position and the trip member to its first position.

2. A dispenser according to claim 1 wherein the register comprises a counter for registering the amount of fluid delivered, having a plurality of coaxial counter wheels of ascending order, a rotatable transfer pinion shaft and rotary transfer pinions mounted on the transfer pinion shaft between the counter wheels adapted to be indexed for generating transfers from lower order to higher order wheels respectively, one of the transfer pinions being secured for rotating the transfer pinion shaft therewith and wherein the drive gear is mounted on the transfer piinion shaft to be angularly indexed by said one transfer pinion.

3. A dispenser according to claim 1 or 2 wherein the reset means comprises spring means biasing the trip gear in its opposite angular direction to its said initial angular position and means for temporarily shifting the trip gear out of engagement with the drive gear to permit the spring means to return the trip gear to its said initial angular position.

4. A dispenser according to claim 1 or 2 wherein the limit mechanism comprises adjustable means for adjusting said initial angular position of the trip gear and for thereby adjusting said established amount of fluid after which the control means is operated by the trip member to deactivate the delivery system.

5. A dispenser according to claim 1 or 2 wherein the reset means comprises manually operable means for temporarily shifting the trip gear to a withdrawn position out of engagement with the drive gear and while in its withdrawn position to reset the trip gear to its said initial angular position.

* * * * *